US005444903A

United States Patent [19]

Wachler

[11] Patent Number: 5,444,903

[45] Date of Patent: Aug. 29, 1995

[54] METHOD OF MAKING A LOOP FOR HANGING JEWELRY

[76] Inventor: Ronald T. Wachler, 9487 Marina Dr., White Lake, Mich. 48386

[21] Appl. No.: 275,113

[22] Filed: Jul. 14, 1994

Related U.S. Application Data

[63] Continuation-in-part of Ser. No. 115,844, Sep. 2, 1993, abandoned.

[51] Int. Cl.[6] ..... B21F 3/00; B21F 43/00

[52] U.S. Cl. ..... 29/160.6; 29/173; 63/5.2; 63/13; 140/102

[58] Field of Search ..... 29/160.6, 173; 140/89, 140/102; 63/2, 5.2, 13

[56] References Cited

U.S. PATENT DOCUMENTS 2,615,478 10/1952 Hopkes, Jr. .
3,645,123 2/1972 Auge .
3,890,800 6/1975 Montague .
3,975,921 8/1976 Pomaski .
4,671,007 6/1987 Stanczyk .
4,741,179 5/1988 McConnell, Jr. .
5,080,518 1/1992 Mason .

FOREIGN PATENT DOCUMENTS 2156717 10/1985 United Kingdom .

*Primary Examiner*—P. W. Echols
*Attorney, Agent, or Firm*—Weintraub DuRoss & Brady

[57] ABSTRACT

A method of making a jewelry loop for displaying charms and similar hanging jewelry such that each loop of the hanger has at least a single charm. Each loop of the hanger is provided with a spring-like quality causing the ends of the loop to spring back together upon deflection and urge against each other to close the loop and prevent the escape of the charms from the loop. The jewelry loop hanger is attachable to jewelry accessories such as necklaces, bracelets, earrings and pins.

15 Claims, 2 Drawing Sheets

FIG 1
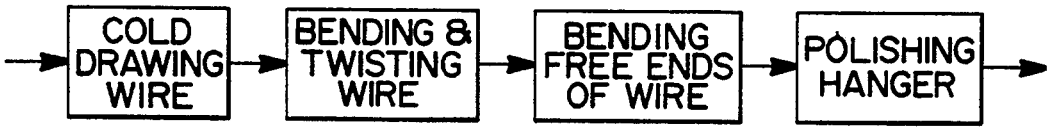
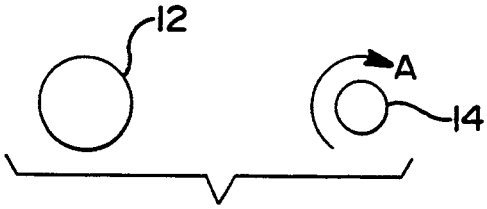
FIG 6
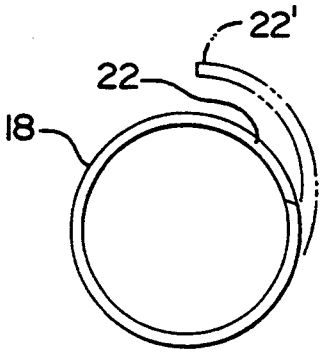
FIG 7
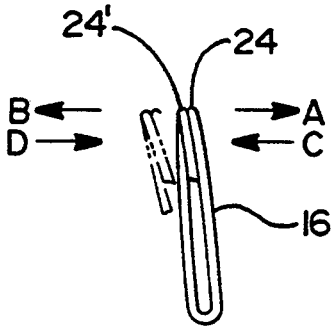
FIG 8

METHOD OF MAKING A LOOP FOR HANGING JEWELRY

This application is a continuation-in-part of co-pending application Ser. No. 08/115,844, filed Sep. 2, 1993, now abandoned, entitled "METHOD OF MAKING A LOOP FOR HANGING JEWELRY" the disclosure of which is incorporated herein by reference.

1. Field of Invention

BACKGROUND OF INVENTION

The present invention relates to a method of making jewelry. More particularly, the present invention relates to a method for making a jewelry accessory. Even more particularly, the present invention concerns a jewelry accessory for holding charms and similar type jewelry.

2. Description of Prior Art

Jewelry accessories for holding charms and similar types of jewelry on necklaces, bracelets, etc., have been in existence for several years. The most commonly known comprise a loop of wire, hingedly attached to one end of a necklace, or the like, and .attachable at the other end to a locking device or clasp provided on the bracelet. Typically, several charms are concurrently hung on the loop of wire, which may bunch the charms together at the bottom of the loop. This obfuscates the beauty of any one individual charm, requiring the wearer to separate it from the other charms.

Devices are known in the art for holding a single charm. Such devices commonly comprise a single loop of metal. The loop opens to receive a charm thereon and is inserted onto a necklace or the like. The loop is, then, closed. Unless the ends of the loop are sealed or locked in some fashion, the charm, eventually, falls from the loop. If the loop is sealed, the loop must be cut open to remove the charm, and in most cases the loop is discarded. If the ends of the loop are locked or engaged in some manner, the lock or engagement must be opened to remove the charms from the loop. Continuous opening and closing may cause wear on the lock and thus reduce its efficiency to hold the loop closed. Additionally, users with arthritic fingers or the like will have a great deal of difficulty using the lock or engagement.

A typical example of a locking loop is found in U.S. Pat. No. 5,080,518 issued to Mason and entitled "Decorative Earrings with Animal Shapes". Mason discloses a single wire earring loop which has a locking device at the ends of the loop. The locking device is manually disengaged to permit charms to be place onto the loop and then manually engaged to prevent the charms from leaving the loop.

It is to be appreciated that the current devices for holding charms and the like suffer from several limitations, as exemplified above. Thus, a device which can be used to display a single charm or several charms, which can function as a piece of jewelry and which can prevent jewelry from escaping the device without sealing or locking the device is highly desirable. It is to this to which the present invention is directed.

SUMMARY OF THE PRESENT INVENTION

The present invention provides a method of making a jewelry hanger for holding charms and other similar type jewelry on at least one loop, the method comprising the steps of:

(a) drawing a wire formed of a precious metal to a first thickness and a first length to a second thickness and a second length, the drawing reducing the cross-section of the wire, the wire obtaining a strain-hardened, spring-like elasticity due to the drawing;

(b) bending the wire to a desired loop design; and (c) twisting the spring-like wire about its longitudinal axis simultaneously with the bending of the wire to generate an initial tension causing a first portion of a loop to spring back and tightly urge against a second portion of the loop.

Thereafter the art-formed loop may be polished to a desired luster.

The method of the present invention produces a jewelry hanger of either a single loop or a plurality of loops. The loops may achieve any length or shape with the ends of the loops in a continually closed condition. In the preferred embodiment, the loop is formed from gold. Other precious metals, such as silver and platinum, may be used in less preferred embodiments.

Each loop hanger, preferably, displays a single charm. This prevents bunching and permits the charm to be viewed and appreciated. However, the loop hanger may be made large enough to permit multiple charms to be attached. Also, the jewelry loop hanger is versatile in being attachable to bracelets, necklaces, pins, earrings or other jewelry accessories. To install the hanger to other jewelry or install charms onto the loop, force is used on the ends of the loop to deflect them from a closed condition. After the installation, the ends spring back to the closed condition securing the hanger to the other jewelry or securing the charms on the hanger.

The present invention will be better understood with reference to the following detailed discussion and to the accompanying drawings in which like reference numerals refer to like elements and in which:

BRIEF DESCRIPTION OF DRAWINGS

FIG. 1 is a flow chart describing the method of the present invention.

FIG. 6 is a cross-sectional view of the wire of a first and second width;

FIG. 7 is a side view of another embodiment of the jewelry loop hanger; and

FIG. 8 is an end view of the preferred embodiment of a jewelry loop hanger shape.

DETAILED DESCRIPTION OF THE INVENTION

Figure 2:
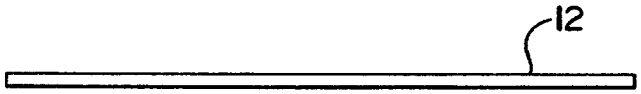
FIG. 2 side view of the wire of a first width and first length.
Figure 3:
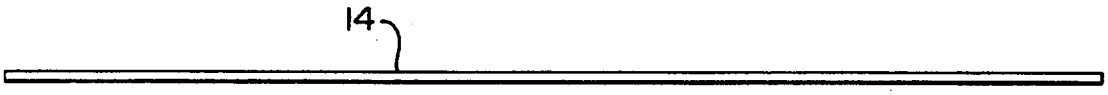
FIG. 3 is a side view of the wire of a second width and second length.

Now with reference to the drawings, FIGS. 1–4, 6 and 7 there is depicted therein a first embodiment of a jewelry loop hanger, designated as 10, made by the method of the present invention. As hereinabove noted, the method hereof, generally, comprises a first step of drawing a wire 12, formed of a precious metal, from a first length and a first thickness, to a second length and a second thickness. This, thus, reduces the cross-section of the wire. Although any drawing method may be used, preferably, an automatic drawing machine (not shown) is used.

The precious metal used for the wire 12 is, preferably, gold, but platinum and silver may, also, be used to make the jewelry loop hangers 10. Additionally, alloy wires such as gold filled wire, brass, gold coated brass, and the like may be used to make inexpensive loops. Preferably the gold wire 12 is about 1 mm around having any desired length. However, any thickness and any cross-sectional shape of wire 12, such as a square wire, may be used.

The drawing machine draws the wire 12 of the first thickness and length through at least one steel drawing plate (not shown), preferably two drawing plates are desired. The drawing plates reduce the cross-section thickness and length of the wire 12 to a wire 14 of a second thickness and second length The wire 12 also acquires a spring-like elasticity by virtue of the process which is described in greater detail herein below.

During drawing, the wire 12 is pulled through at least one plate, which reduces the cross-section of the wire, as denoted as element 14. By this reduction, a strain-hardening of the wire is achieved, further causing the wire 14 to acquire a spring-like elasticity. Strain-hardening is defined as a process which increases the hardness and strength of the precious metal wire 14 as it is cold-drawn to reduce the size of the cross-section of the wire. After strain-hardening, the wire 14 must not be heated in any manner, else the wire 14 will lose its elasticity. In practice, the spring-like wire 14 has a thickness of about 0.7 mm in diameter, but may be any thickness which facilitates or allows the spring-like elastic quality. The wire 14 may also be any length. Likewise, the drawn wire 14 may be cut, by any suitable means, into a lesser length. This provides a plurality of wires 14, as may be desirable in a large scale production.

After drawing, the wire 14 is then shaped into a hanger 10 having at least one loop 18 of a desired diameter and shape, a circular loop being the preferred embodiment. Although any means for bending may be employed, preferably mechanical means such as any well known wire bending machine, one preferred selection being the Itaya Computerized Coiler, manufactured by Itaya of Tokyo, Japan, may be used.

Figure 4:
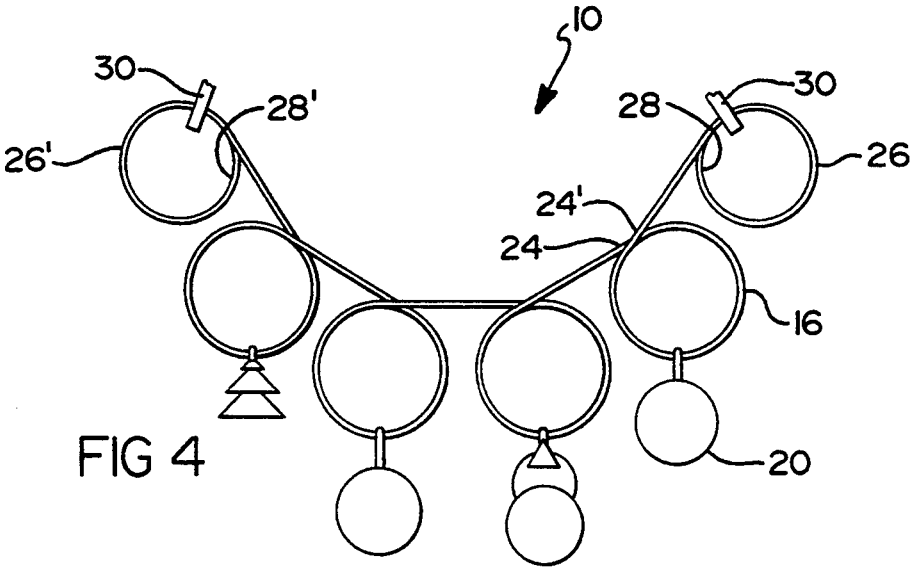
FIG. 4 is a side view of the preferred embodiment of a jewelry loop hanger shape.

The wire 14 is shaped into a hanger 10 of at least one loop 18. Referring to FIG. 4, there is shown a hanger 10 of a plurality of connected loops 16. Alternatively, and as shown in FIG. 7, the hanger 10 may have a single loop 18.

When the wire 14 is shaped into a plurality of connected loops 16, each loop is unitarily formed with the next loop. The hanger 10 of the plurality of loops 16 has a terminating loop 26, 26' disposed at each end of the hanger 10. Each terminating loop is unitarily formed with the adjacent loop and has a free end 28, 28' respectively, the free end defining the termination of the shaped wire 14. When the hanger 10 is shaped into a single loop 18, as shown in FIG. 7, the loop 18 has two free ends 22, 22' which define the termination of the shaped wire 14.

As shown in FIGS. 4, 6 and 8, the shaping of the wire 14 into the desired loop design is accomplished while concurrently twisting the wire 14 about its longitudinal axis. The spring-like elasticity of the wire 14 generates an initial tension due to this twisting, which causes a first portion 24 of a loop to spring back and tightly urge against a second portion 24' of a loop. The wire 14 is twisted in the direction A, as indicated in FIG. 6 or, alternatively, the wire 14 may be twisted in the opposite direction.

As noted and referring to FIGS. 4, 6 and 8, and in accordance herewith, the spring-like or initial tension of the wire 14 causes the first and second portion 24, 24' of the loop 18 to spring back after deflection and urge against each other. The continuous spring-like tension keeps the loop 18 closed, thus, permitting a bangle or charm 20 to be suspended on the loop 18 while preventing the bangle 20 from escaping the loop. The first and second portions 24, 24' of the loop are manually separated or opened by forcing the portions 24, 24' apart in the direction of A and B, respectively as shown in FIG. 8. When the force is released, the portions 24, 24' of the loop 16 spring back in the direction D and C, respectively, as shown in FIG. 8 to close the loop. The initial tension is essentially a force or load accomplished by the twisting which causes the first portion 24 of the loop to continuously press against the second portion 24' of the loop until an opposing greater force or load is applied to separate the portions 24, 24'.

After being formed, the jewelry loop hanger 10 is polished, such as in a polishing machine to polish the jewelry loop hanger to any desired luster which are well known in the art.

In the preferred embodiment hereof, and when used, the bending machine shapes the jewelry loop hanger 10 into a series of continuous circular loops 16. However, as noted, the jewelry loop hanger 10 may consist of a single loop 18 when desired. When the hanger 10 comprises a series of multiple loops 16, each free end 28, 28' of the terminating or outside loops 26, 26' of the multiple loop hanger 10 radially overlap and conform to the shape of the loops 26 and 26' respectively, while urging against the first portions 24 of the loops 26, 26". When the shaped hanger 10 comprises a single loop 18, both ends 28, 28' of the loop 18 are free ends 22, 22' which overlap and conform to the shape of the single loop 18 while urging against each other. As noted, the hanger 10 is also removably attachable to a jewelry accessory 30. The accessory 30 is installed onto the hanger 10 by forceably separating the free end. 28 from the first portion 24 of the outside loop 26 to open the loop 26. When the loop 26 is open, the accessory 30 is installed into the loop of the wire 14. After the accessory 30 is installed, the free end 28 is released to allow the end 28 to spring back and urge against the first portion of the loop 26. Shaping the free ends 28, 28' to conform to the shape of the loops 26, 26' and urge against the loops 26, 26' prevents the hanger 10 from escaping from any accessory 30 it is attached to or from snagging or catching on a foreign object and provides a pleasingly aesthetic appearance.

The above-described method provides a jewelry loop hanger 10 for displaying a single charm 20 and other jewelry that is desired to be similarly displayed.

Alternatively, any commonly known extruding process may be used to reduce the thickness of the wire 12. However, this process is not preferred because of the need to heat the wire 12 to reduce its thickness during extrusion. As previously noted, heat treatment causes the wire to lose its spring-like elasticity.

Figure 5:
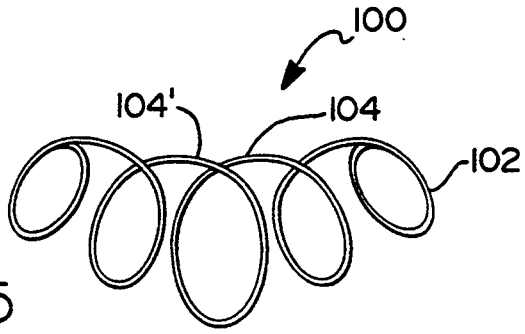
FIG. 5 a side view of an alternative embodiment of the jewelry loop hanger.

As noted, the jewelry loop hanger 10 may have alternative shapes. As shown in FIG. 5, an alternative embodiment of the jewelry loop hanger 100 has an oval shaped loop 102. Herein, the wire 14 must be twisted during bending and shaping to cause the ends 104, 104' of the loop to urge against each other. Likewise, any other geometric configuration can be generated and used herein. The loop 102 hereof may be used to suspend or display a single charm or a plurality of charms.

The jewelry loop hanger produced by the above-described method may be used to display items, such as the charms from a necklace, bracelet, earrings, jewelry pins and other similar types of jewelry accessories. The jewelry loop hanger may be hung from the accessories or may be more permanently attached to the accessory by soldering, welding or the like.

The hanger is easy to use and can be easily assembled to the above accessories. Also the hanger may be easily exchanged between accessories. There are no locking devices to fail or cause problems for users with arthritic or other physical conditions that would interfere with using small jewelry items.

Having, thus, described the invention, what is claimed is:

1. A method of making a jewelry loop hanger, the method comprising:

(a) drawing a wire formed of a precious metal and of a first cross-section thickness and first length to a second cross-section thickness and a second length, the wire obtaining a strain-hardened spring-like elasticity;

(b) concurrently bending the wire to a desired shaped loop hanger design while twisting the spring-like wire about its longitudinal axis, the twisting of the wire generating an initial tension in the wire causing a first portion of a loop to spring back and tightly urge against a second portion of the loop.

2. The method of claim 1 further comprising the step of:

bending free ends of loops such that the free ends conform to the shape of the loops.

3. The method of claim 2, which further comprises the step of:

polishing the jewelry loop hanger to a desired luster.

4. The method of claim 3, which further comprises:

loading the jewelry loop hanger into an automatic polishing machine.

5. The method of claim 1 wherein, after the step of drawing the wire, further comprising the step of:

cutting the spring-like wire into a plurality of pieces.

6. The method of claim 1, wherein the precious metal wire is formed from gold.

7. The method of claim 1, wherein the precious metal wire is formed from platinum.

8. The method of claim 1, wherein the precious metal wire is formed from silver.

9. The method of claim 1 wherein the hanger design comprises at least one loop.

10. The method of claim 1, wherein the hanger design comprises a plurality of loops.

11. A method of making a jewelry loop hanger, the method comprising:

(a) drawing a precious metal wire of a first cross-section thickness and first length to a second cross-section thickness and a second length, the wire of the second cross-section thickness and length being strain-hardened by the drawing to achieve a spring-like elasticity; and (b) simultaneously bending the drawn wire to form a loop hanger of at least one loop of a desired shape and twisting the drawn wire about its longitudinal axis, the twisting generating an initial tension causing a first portion of each of the at least one loop to spring back and urge against a second portion of each of the at least one loop.

12. The method of claim 11 wherein the forming of at least one loop comprises:

forming a plurality of loops.

13. The method of claim 12 further comprising the step of: bending free ends of each outside loop of the plurality of loops to overlap and conform to the shape of the outside loops.

14. The method of claim 11 wherein the forming of at least one loop comprises:

forming a single loop.

15. The method of claim 14 further comprising the step of:

bending free ends of the single loop to overlap and conform to the shape of the loop.

* * * * *